United States Patent [19]

Lee

[11] 4,431,108

[45] Feb. 14, 1984

[54] CLOTHES HANGER SUPPORT

[76] Inventor: Ellis M. Lee, 22534 Millgate, Spring, Tex. 77373

[21] Appl. No.: 202,479

[22] Filed: Oct. 31, 1980

[51] Int. Cl.[3] ..... A47F 5/08

[52] U.S. Cl. ..... 211/113; 248/337; 211/117

[58] Field of Search ..... 211/113, 115, 117; 248/333, 337; 403/85, 84, 102

[56] References Cited

U.S. PATENT DOCUMENTS

| | | | |
|---|---|---|---|
| 219,884 | 9/1879 | Wellington | 248/337 |
| 435,561 | 9/1890 | Frank | 211/117 |
| 492,015 | 2/1893 | Hines et al. | 211/117 X |
| 495,409 | 4/1893 | Fry | 211/117 |
| 1,222,242 | 4/1917 | Payne et al. | 211/115 |
| 1,637,688 | 8/1927 | Emel | 211/117 |
| 1,858,595 | 5/1932 | Parker et al. | 211/117 |
| 1,892,794 | 1/1933 | Wertzler | 211/117 |
| 2,193,215 | 3/1940 | Witter | 211/117 |
| 2,747,746 | 5/1956 | Laughton | 211/113 |
| 2,936,076 | 5/1960 | Harris | 211/113 |
| 2,957,672 | 10/1960 | Logan | 211/113 X |
| 3,093,246 | 6/1963 | Horton | 211/113 |
| 3,383,082 | 5/1968 | Larson | 248/337 X |
| 3,415,386 | 12/1968 | Ogilvie | 211/118 |
| 4,289,292 | 9/1981 | Kunjumon | 211/117 X |

*Primary Examiner*—William E. Lyddane
*Assistant Examiner*—Peter A. Aschenbrenner
*Attorney, Agent, or Firm*—Vaden, Eickenroht, Thompson, Bednar & Jamison

[57] ABSTRACT

A vertical, retracting, tubular clothes hanger support having an outer member secured to an overhead support with an inner member slideably mounted within the outer member. A spring retracts the inner member into the outer member for convenient storage. The outer member at its lower end carries an inward tapered shoulder and the inner member carries at its upper end a complementary outward tapered shoulder. The shoulders provide sliding bearings as the members are telescoped. With the inner member extended fully into its downward position, the tapered shoulders engage into a locked position and secure the members in the extended position. The lower portion of the inner member carries a horizontal cross support that is adapted to receive clothing hangers. Preferably, this support is releasably mounted to the inner member for convenient removal whereby several mounted clothes hangers can be removed in unison by the user.

The horizontal cross member is uniquely designed to provide a removeable carrier for a plurality of clothing hangers and to be selectively secured with a snap action into its mounting at the end of the inner member.

Additionally, other forms of an accessory stripper carrier may also be employed in association with the clothes hanger support in addition to the unique removeable horizontal cross support.

13 Claims, 8 Drawing Figures

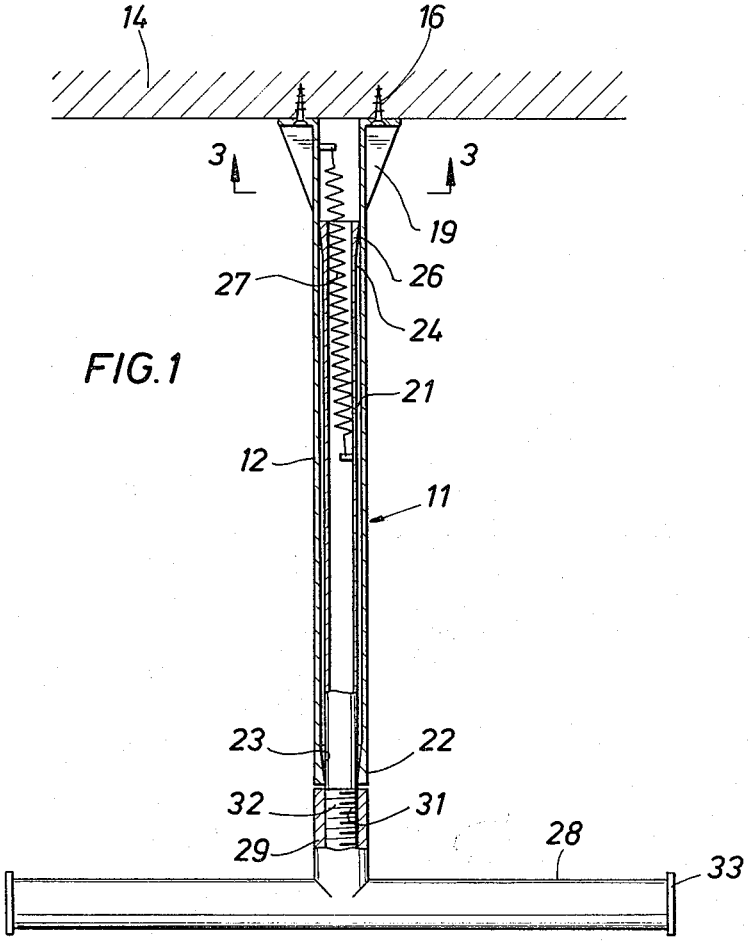
FIG. 1
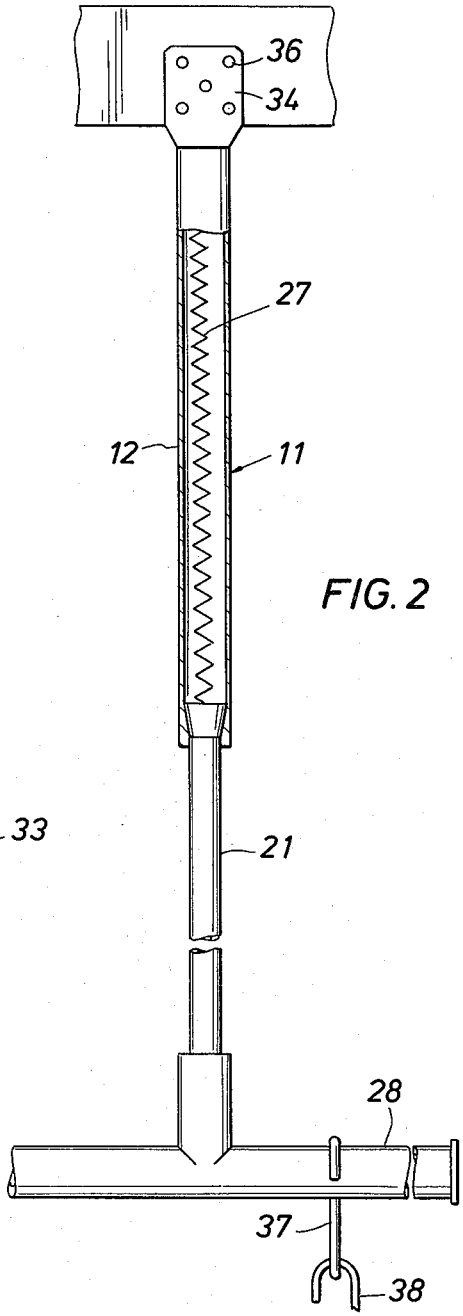
FIG. 2
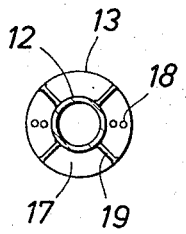
FIG. 3
FIG. 4
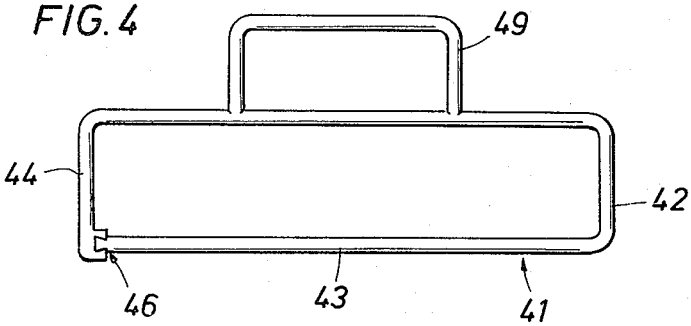
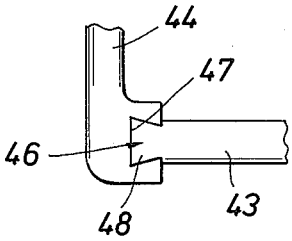
FIG. 5

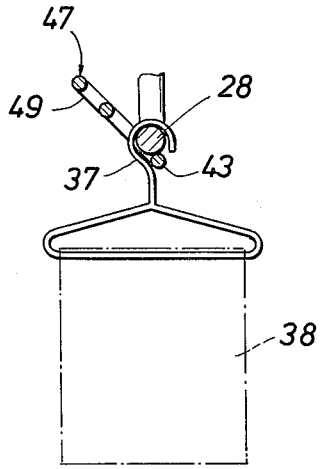
FIG. 6
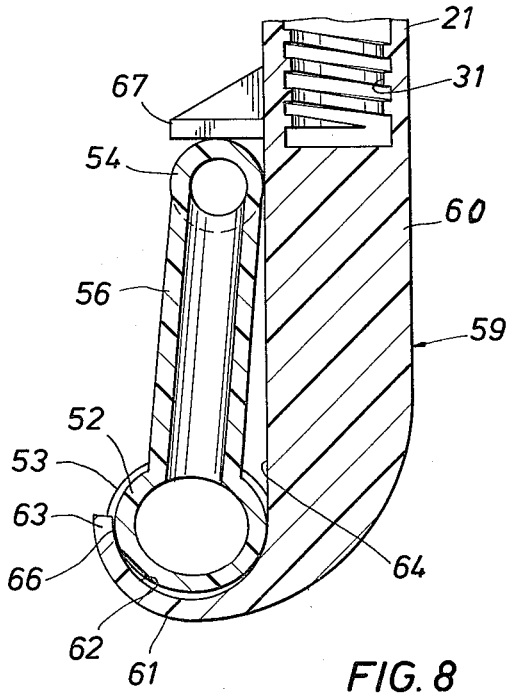
FIG. 8
FIG. 7
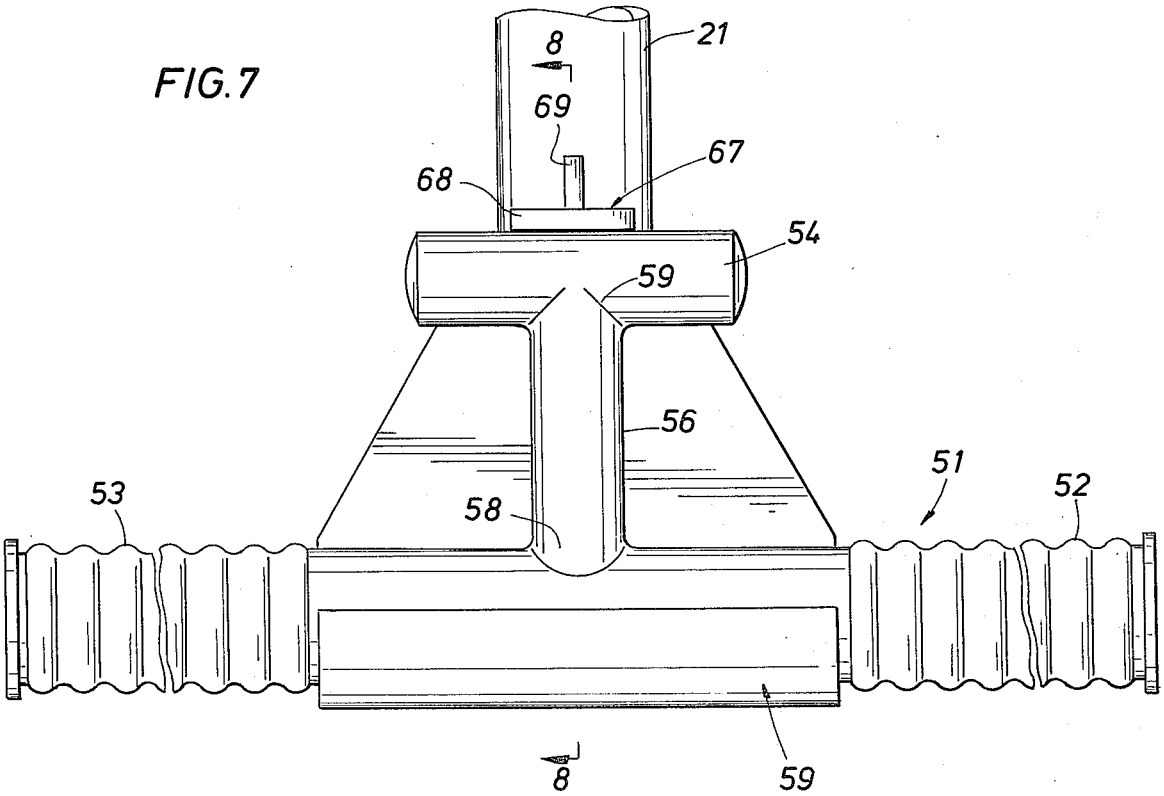

CLOTHES HANGER SUPPORT

BACKGROUND OF THE INVENTION

1. Field of the Invention

This invention relates to supports and racks for mounting of clothing hangers and the like, and more particularly, it relates to such supports or racks that may be lowered for use, or retracted upwardly into a storage position.

2. Description of Prior Art

There have been many designs of supports or racks for the convenient mounting of clothing hangers. Many of these supports are of a specialty nature such as used in a cleaning and pressing facility, or by users employed in the garment or sewing industry. Many of such supports have structures for mounting upon an overhead support. When desired, these supports are lowered to a position where the user can readily mount clothing hangers onto them. After the hangers are removed, these supports are retracted upwardly into a storage position. Possibly because of the specialized nature of their use, these retractable supports or racks have complicated structures, and in many cases employ complex or difficult to operate mechanisms for their extension or retraction. In addition, the clothing hangers mounted upon such a downwardly extended support must be handled manually and removed individually from the support for transportation to another area.

The clothes hanger support of the present invention is fabricated from relatively simple and easy to make, but durable elements. It is light in weight and permits a ready mounting to an overhead surface. The support retracts into an upward position clearing the work area in its surroundings. When it is desired to place the support into use, a simple downward pull upon the support extends it into a fully extended position and it automatically locks in such downward position. A simple upward movement upon the support produces its automatic retraction into a storage position.

Additionally, this novel support can accept a plurality of clothing hangers upon a horizontal cross support. The user can conveniently remove this cross support from the remainder of the device and carry the plurality of hangers to another work area or other location on the cross support. If desired, a plurality of horizontal cross supports which can form accessory stripper carriers to be used with the basic clothing hanger support. Thus, when one of the horizontal cross supports is filled with clothing hangers, it may be readily removed and replaced by an unloaded one. If desired, a different accessory strip carrier may be employed with the basic clothing hanger support for removing the plurality of clothing hangers directly from the horizontal cross support attached to the retracting support.

The novel clothes hanger support of this invention, will find great utility in dwellings, especially in the limited floor space wherein occurs the washing and drying of clothes. More particularly, the modern dwelling has relatively small floor space available for the washers and dryers presently employed for cleaning and drying clothing. The clothing hanger support of the present invention can be mounted to an overhead surface within the limited floor area of such dwellings and extended downwardly for the convenient mounting of ready to wear and other types of apparel upon clothing hangers. Upon completion of its task, the clothing hanger support is retracted into the upward position clearing the work area for other uses.

SUMMARY OF THE INVENTION

In accordance with this invention, there is provided a retracting clothing hanger support which has first and second telescopic tubular members. The first member at one end carries a mounting plate adapted to be secured to an overhead surface. The second member at one end mounts a cross support adapted to receive a plurality of clothing hangers. The first member at its other end has a tapered locking surface. The second member at its other end also has a tapered locking surface that is adapted to wedge into a locking position against the tapered locking surface of the first member when the first and second members are extended to their maximum extended length. A resilient mechanism interconnects the members whereby the first and second members are retracted to a minimum length with their respective tapered locking surfaces are disengaged.

In other embodiments of the invention, there is provided a unique cross support for mounting the clothing hangers that can be readily removed from the second member. In addition, the cross support may be arranged so as to provide an accessory stripper carrier to be associated in cooperation with a plurality of clothing hangers are readily removed in unison from the retracting clothes hanger support.

DESCRIPTION OF THE DRAWINGS

FIG. 1 is an elevation, partially in section, illustrating one embodiment of the present invention with the clothes hanger support retracted into a storage position;

FIG. 2 is a view like FIG. 1 but showing the support extended into its full downward and locked position, and the support carrying a flange mounting plate for mounting upon a horizontal overhead surface;

FIG. 3 is a sectional view taken along line 3—3 of FIG. 1;

FIG. 4 is an illustration of an accessory carrier stripper employed in association with the clothes hanger support shown in the preceding views;

FIG. 5 is a partial enlarged illustration of a separable joint used in the accessory stripper carrier shown in FIG. 4;

FIG. 6 is a pictorial view illustrating the use of the accessory stripper carrier for the removal of a plurality of clothing hangers in unison from the clothes hanger support shown in FIGS. 1 and 2;

FIG. 7 is a partial view in enlargement of the lower portion of the clothing hanger support but including a unique removeable cross support for the mounting of a plurality of clothing hangers; and FIG. 8 is a vertical section taken along line 8—8 of the support shown in FIG. 7.

In these drawings, the several embodiments of the clothes hanger support have common elements of construction. In this regard, like elements will carry like numerals to simplify description of these several embodiments of the present clothing hanger support.

DESCRIPTION OF PREFERRED EMBODIMENTS

Referring to FIG. 1, there is shown a clothes hanger support 11 which is arranged in accordance with one embodiment of this invention. The support 11 is formed of an outer tubular member 12 which at its upper end carries a mounting plate 13 that is adapted to be secured to an overhead surface, such as a ceiling 14, by a plurality of screws 16 that traverse the plate in a conventional manner. Referring momentarily to FIG. 3, the mounting plate 13 consists of a circular base 17 carrying a plurality of openings 18 to accommodate the screws 16. The base 17 is reinforced in its integral carrying of the member 12 by a plurality of webs 19. An inner tubular member 21 is slideably mounted within the member 12. These members can be moved into the retracted or storage position shown in FIG. 1 or the extended and locked position shown in FIG. 2.

The members 12 and 21 are journaled for sliding movements relative to each other, and also lock elements to secure these members in their extended position as is shown in FIG. 2. More particularly, the member 12 at its lower end carries an inward, tapered shoulder 22 which takes the form of a downwardly oriented conical locking surface 23. The minimum opening diameter of the shoulder 22 is substantially the diameter of the member 21. As a result, the shoulder 22 forms a sliding journal bearing between the members 12 and 23. Similarly, the member 21 at its upper end carries an outward tapered shoulder 24. The shoulder 24 produces an upwardly oriented conical locking surface 26 that is arranged to cooperate with the surface 23 in a wedging action so that the member 21 in its most downward position causes these surfaces 23 and 26 to engage, and thereby lock the members 12 and 21 into their downward maximum extended position. The maximum exterior diameter of the shoulder 24 is substantially the internal diameter of the member 12 and therefore provides a second sliding bearing when the members 12 and 21 are telescoped in use of the support 12.

The taper of the surfaces 23 and 26 will depend to a great extent upon the material from which the members 12 and 21 are constructed. Preferably, these members are constructed from a high density plastic material, such as nylon or polystyrene. However, various metals could be used for these members such as aluminum or steel. The taper of the surfaces 23 and 26 should be sufficient to lock these members in their extended position without causing a cracking or rupturing of the members. In addition, the taper of these surfaces should be sufficient to maintain the members 12 and 21 in their extended position against the biasing force of a resilient member or spring 27 that is interconnected between the outer member 12 and the inner member 21. It will be apparent that the spring 27 holds the inner member 21 in its upward or storage position when the locking surfaces 23 and 26 are released from one another.

The member 21 at its lower end carries a cross support 28 that is adapted to receive one or more clothing hangers. The cross support 28 is arranged horizontally relative to the vertical orientation of the members 12 and 21 of the support 11. More particularly, the cross support 28 can be secured to the member 21 by a socket 29 which is integrally carried mid-length of the support 28. The socket 29 carries internal threads 31 in which are releaseably received a threaded end 32 formed on the lower end of the member 21. The upper end of the socket 29 abuts against the planar end of the shoulder 22 upon the outer member 12. Thus, there is provided a positive stop between the members when they are in their retracted position.

For example, the overall length in the retracted position of the support 11 may be 1 foot. With an eight foot ceiling of a modern dwelling, the clearance beneath the support 28 will be about 7 feet so that the occupants of the dwelling will not encounter it in its stored position. Similarly, when the support 28 is pulled downwardly and the locking surfaces 23 and 26 engage to secure the inner member in its most downward position, the support 28 is at a comfortable height of about 6 feet for the ready receipt of one or more clothing hangers. The ends of the support 28 are provided with caps 33 to prevent the clothing hangers from inadvertantly being displaced to fall to the floor below.

The support 11 is shown in FIG. 2 in its downward extended position wherein the surfaces 23 and 26 are engaged to lock the member 21 in its most extended or downward position. At this time the spring 27 has been pulled to its maximum extended length. In this view, the member 12 is provided with vertical flat mounting plate 34. A plurality of holes 36 in the plate 34 receive screws for mounting to a vertical flat surface, such as a beam, door framing or the like. There is shown in FIG. 2, a conventional clothing hanger 37 mounted upon the support 28. The hanger 37 carries a garment 38 which for descriptive purposes may be trousers. The full extended member 21 is locked to the member 12 so that the hanger and garment may be removed from the support 28 but the support 11 will remain in the extended position until the member 21 is given intentionally an upward movement to release the lock surfaces 23 and 26. At that time, the spring 27 automatically retracts the member 21 into the member 12 into its storage position as shown in FIG. 1.

When the cross support 28 is completely filled with clothing hangers, it would be desireable to remove the clothing hangers in unison and carry them to some other work location. For this purpose, there is provided an accessory strip carrier that can be used with the novel clothing hanger support. One embodiment of such a strip carrier is shown in FIGS. 4, 5 and 6. The carrier 41 is comprised of a rectangular frame 42 which is preferably formed of a semiflexible material such as a springy metal or plastic material. The frame 42 includes an integral lower bar member 43. However, the bar member 43 at one end is interconnected to a side part 44 of the frame 42 by a releaseable joint 46. Referring momentarily to FIG. 5, the releaseable joint 46 consists of a socket 47 that is complementary to an end 48 carried on the bar 43. The socket 47 may have a dove tail configuration whereas the bar 43 may carry a tapered end 48 which is adapted to slideably interfit to form the releaseable joint 46. Thus, the bar 43 is slid sideways to open the joint 46 to separate the end 48 from the side part 44 of the frame 42. The frame 42 also carries a loop handle 49 that provides a convenient grip for the user in handling this carrier 41.

Referring to FIG. 6 the carrier is used by opening the joint 46 and passing the bar 43 beneath the ears of the hangers immediately below the cross support 28. Then, the end 48 in interfitted into the socket 47 and the joint 46 is closed. Then, the user grasps the handle 49 and raises the carrier to lift the desired hangers 37 from the support 28. Thus, a plurality of hangers may be removed in unison from the support 28 by using the carrier 41.

Referring now to FIGS. 7 and 8, there is shown another embodiment of the present support 11 having a unique cross support 51 that is removeably mounted on to the inner member 21. In this manner, the such support 51 serves as an accessory stripper carrier in the fashion of the carrier 41.

More particularly, the cross support 51 is formed of a horizontal tube 52 which may be provided with a plurality of annular ridges 53 so that the clothing hangers mounted upon it do not slide longitudinally relative to its length. The tube 52 is connected to a handle. Preferably, the handle is in the form of a tee so that the user may readily grasp it in removing the support 51 from its mounting upon the end of the member 21. The handle can be a short tubular member 54 that is positioned substantially mid-length of the tube 52 and is integrally secured thereto by a transverse body 56. The body 56 may be formed integrally by plastic molding with the tube 52 and the handle 54. However, these members can be formed separately and then interconnected by using a suitable adhesive, on saddle ends 57 and 58 formed upon ends of the body 56.

The member 21 is provided with a unique mounting for the releaseable carrying of the support 51. More particularly, the lower end of the member 21 is formed into a jay hook 59. As best can be seen in FIG. 8, the jay hook 59 is comprised of a semi-cylindrical flange 61 that is interconnected to the member 21 by a flaring portion 60. The flange 61 has at its lower portions a semi-cylindrical surface 62. However, it is preferred that the end 63 of the flange 61 be turned inwardly so as to decrease the opening between the end 63 and the planar backwall 64. Although the tube 52 can have a circular cross section, it is preferred that the tube 52 is elliptical in cross section, wherein the major axis is perpendicular to a transverse plane extending through the tube 51 and the body 56. Thus, the support 51 is positioned with the tube 52 resting within the semi-cylindrical surface 62. Then, the handle 54 is pushed towards the backwall 64 wherein the inwardly turned end 63 of the flange 61 engages the maximum diameter portion of the tube 52. As a result, the elliptical tube 52 is wedged into the flange 61.

In addition, it is preferred that the support 51 also have some other security against inadvertant displacement. For this purpose, the support 51 and the jay hook 59 are arranged to interengage with a snap action function. For this purpose, a latch projection 67 is integrally carried upon the jay hook 59. Preferably, the latch projection is formed of a flat tab 68 which is reinforced by a filet 69 which is carried upon the member 21. The latch projection 67 is so arranged relative to the flange 61 of the jay hook 59 that upon the movement of the tee handle 54 towards the backwall 64, it engages tightly the most forward presented portion of the latch projection 67. As the tee handle 54 passes this initial projection, it will eventually rest beneath the latch projection 67 and against the backwall 64. Assuming the latch projection 67 has some resiliency (either of its own or through the construction of the jay hook 59), there will be a snap action in securing the tee handle 54 beneath the latch projection 67 and against the backwall 64. Obviously, the tee handle 54 is readily grasped and pulled from beneath the projection 67 when it is desired to rotate and lift it from the jay hook 59. Then a plurality of hangers in unison may be carried on the support 51 to some other work location.

Preferably, the jay hook 59 is constructed of a unitary molded piece of plastic material in a similar construction as were the members 12 and 21. It may be desireable to mold the threads 31 internally of the portion of the member 21 adjacent the upper part in the region where the latch projection 67 is located. Other means of forming the jay hook 59 and its associated components may be employed, if desired.

It will be apparent that several of the cross supports 51 may be used with one support 11. For example, when a support 51 is filled with hangers, it may be readily removed from the member 21 and carried to a suitable work location. At this time, a second support 51 may be mounted within the flange 51 and secured through the snap action mounting associated with the tee handle 54 and the latch projection 67. Other arrangements of utilizing the support 51 as an accessory stripper carrier will be apparent.

From the foregoing, it will be apparent that there has been provided a novel clothes hanger support which provides for a convenient and useful means for hanging a plurality of coat hangers from a support. When the hangers are removed, the support is retracted into a stored position to clear the work area. In particular, this unique clothes hanger support is constructed of simple elements of good durability and without complicated structures and mechanisms. In particular, portions of the novel support herein described have utility separately and apart from the clothing hanger support. For example, the carrier, and the easily removeable cross support, can find utility for carrying a plurality of hangers between work locations and the clothing hanger support. It will be appreciated that certain changes or alterations in the present retracting clothes hanger support and its unique components may be made without departing from the spirit of this invention. These changes are contempleted by and are within the scope of the appended claims which define the invention. Additionally, the present description is intended to be taken as an illustration of this invention.

What is claimed is:

1. A retracting clothes hanger support comprising:

(a) first and second telescoping tubular members;

(b) said first member at one end carrying a mounting plate adapted to be secured to an overhead surface;

(c) said second member at one end mounting a cross support adapted to receive clothing hangers;

(d) said first member at its other end having a tapered locking surface;

(e) said second member at its other end having a tapered locking surface adapted to wedge into a locked position against the tapered locking surface of said first member when said first and second members are extended to a maximum telescoped length; and (f) resilient means interconnecting said first and second members whereby said first and second members are retracted to a minimum telescoped length with their respective tapered locking surfaces are disengaged.

2. The retracting clothes hanger support of claim 1 wherein said cross support is removably mounted onto said second member.

3. The retracting clothes hanger support of claim 2 wherein said cross support includes a tee handle.

4. The retracting clothes hanger support of claim 3 wherein said cross support is tubular and is received within a jay hook carried at the end of said second member.

5. The retracting clothes hanger support of claim 4 wherein said jay hook carries a latch and said tee handle on said cross support is releaseably secured with a snap action under said latch.

6. The retracting clothes hanger support of claim 5 wherein said tee handle is rearwardly of a plane extending vertically through said tubular cross support.

7. A vertical retracting tubular clothes hanger support comprising:

(a) an outer tubular member at its upper end carrying a mounting plate adapted to be secured to an overhead surface;

(b) an inner tubular member slideably mounted within said outer tubular member whereby said tubular members can be telescoped between an upward retracted length and a downward extended length;

(c) said outer tubular member at its lower end carrying internally a downwardly oriented conical locking surface;

(d) said inner tubular member at its upper end carrying externally an upward oriented conical locking surface;

(e) resilient means interconnecting said inner and outer tubular members whereby said inner tubular member is biased for retraction upwardly into said outer member;

(f) said conical locking surfaces on said inner and outer tubular members wedging into a locked position to hold said inner tubular member in its downward extended length against said resilient means, and said conical locking surfaces providing bearings during telescoping of said inner and outer members; and (g) said inner tubular member at its lower end mounting a cross support adapted to receive clothing hangers.

8. The clothes hanger support of claim 7 wherein said cross support is removably mounted onto said inner tubular member.

9. The clothes hanger support of claim 8 wherein said cross support is elliptical and rests within a semi-cylindrical hook member carried on said inner tubular member, and snap action latching means releaseably secure said cross support within said hook member.

10. The clothes hanger support of claim 9 wherein said cross support carries a tee handle to be grasped by the user in removing said cross support from said hook member.

11. The clothes hanger support of claim 10 wherein said tee handle is received with a snap action beneath a latch extending laterally from said inner tubular member.

12. The clothes hanger support of claim 7 wherein said cross support is associated with means for removing in unison a plurality of clothing hangers from their support by the inner tubular member.

13. The clothes hanger support of claim 12 wherein said cross support is provided with a handle for the user to grasp in removing the clothing hangers from the support.

* * * * *